United States Patent [19]

Zuk

[11] Patent Number: 4,487,125

[45] Date of Patent: Dec. 11, 1984

[54] TIMING CIRCUIT

[75] Inventor: Borys Zuk, Somerville, N.J.

[73] Assignee: RCA Corporation, New York, N.Y.

[21] Appl. No.: 405,451

[22] Filed: Aug. 5, 1982

[51] Int. Cl.[3] ..... F42C 11/06

[52] U.S. Cl. ..... 102/220; 102/206

[58] Field of Search ..... 102/200, 206, 215, 217, 102/218, 220; 361/248, 251; 315/209 T, 209 CD, 209 SC

[56] References Cited

U.S. PATENT DOCUMENTS

| | | | |
|---|---|---|---|
| 4,136,617 | 1/1979 | Fowler | 102/220 |
| 4,328,751 | 5/1982 | Oswald | 102/220 |
| 4,355,263 | 10/1982 | Buhrlen | 315/209 |
| 4,374,492 | 2/1983 | Goldberg et al. | 102/220 |
| 4,409,897 | 10/1983 | Kirby et al. | 102/200 |

OTHER PUBLICATIONS

"Item A" Confidential Correspondence between RCA Personnel and Atlas Powder Co. Personnel.

J. J. Carr *The Complete Handbook of Amplifiers, Oscillators and Multivibrators,* TAB Books Inc., Blue Ridge Summit, PA, 2/1981, pp. 293-307.

"A4-Digit, 7-Function Stopwatch/Timer" AN-169 National Semiconductor, MOS Data Book, (1977), pp. 2-33 to 2-46.

"COS/MOS Programmable Divide-By-N Counter" *RCA COS/MOS Integrated Circuits,* 9/1980, pp. 565-572.

"Crystal Control of a One-Shot Ensures Accurate Pulse-Width Output", M. F. Black, Electronic Design 24, Nov. 22, 1975, p. 150.

*Primary Examiner*—Charles T. Jordan

*Attorney, Agent, or Firm*—Joseph S. Tripoli; George E. Haas; Henry I. Schanzer

[57] ABSTRACT

A timing circuit is described which includes a storage capacitor, a switch, and a load to be energized in a closed loop. A programmable timer, energized by the storage capacitor controls the switch. An external potential is applied to charge the capacitor and hold the timer in a reset mode. Upon removal of the external potential the timer is enabled and closes the switch a predetermined time thereafter.

10 Claims, 2 Drawing Figures

TIMING CIRCUIT

BACKGROUND OF THE INVENTION

This invention relates to timing circuitry, and more particularly to circuitry which commences its timing cycle when external power is removed. At the end of the timing cycle current is switched through a load.

This type of circuitry has utility in detonating explosives and will be described in that context. In quarry mining, for example, explosive charges are placed in holes that are drilled in the strata in predetermined configurations to produce shock waves that make most efficient use of the explosives. In order to generate the desired shock wave, the charges are detonated in a particular sequence. Heretofore, the sequencing has been accomplished by basically two methods. The first method utilizes a master console to which all of the charges are wired. The console is then programmed to electrically detonate the charges in the desired sequence. This method, although it provides precise detonation timing, promotes its own malfunction due to first explosions disturbing electrical connections to non detonated charges. The second method employs detonators which provide a combination of electrical ignition, and a chemical delay, e.g. variable length fuses. In this instance each of the charges are simultaneously primed electrically and the detonation sequence is thereafter produced by the varying length of chemical delay built into each charge. Detonation of later charges is rarely affected by the first detonated charges, however, the sequencing is far less precise.

SUMMARY OF THE INVENTION

The present invention is a relatively inexpensive programmable electronic timer which may be adapted for detonating an explosive at a precise preset time after being energized. The circuit includes a programmable timer, a storage capacitor and a switch which closes a serial loop including the storage capacitor and the load to be energized. The timing circuit controls the switch, determining when the storage capacitor will be discharged through the load.

Supply potential of either potential is applied across the storage capacitor thorough a bridge rectifier to establish the proper polarity. The charged capacitor provides the circuit with a self-contained energy souroe. A portion of the potential across the capacitor is regulated to energize the timer which is held in the reset mode by the applied supply potential. Once the supply potential is removed, so to is the timer reset control and the timer begins to time out its programmed timing cycle. At the end of the timing cycle, the switch is closed and the charge on the capacitor is conducted through the load, e.g. a blasting cap detonator.

To utilize these devices in a blasting operation, a timer will accompany each explosive charge. Each circuit will be programmed in accordance with the desired detonation sequence. All of the circuits will be wired in parallel across supply potential and at the designated time the supply will be removed from all circuits thereby simultaneously starting each timer. Each timer is a self-contained unit which cannot be affected by nearby explosions disturbing the supply potential wires.

DETAILED DESCRIPTION OF THE DRAWINGS

Figure 1:
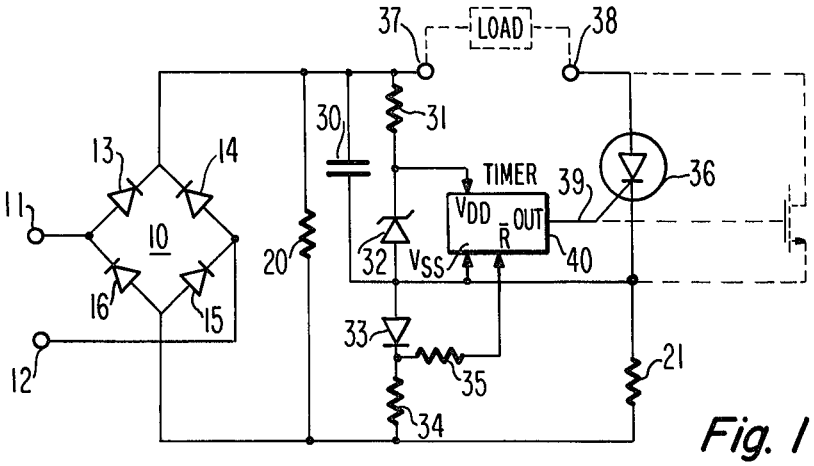
FIG. 1 is a partial block and partial schematic diagram of a timing circuit embodying the present invention.

FIG. 1 shows a timing circuit for energizing a load to be connected to terminals 37 and 38. The storage capacitor 30 provides the energy for energizing both the load and the timer 40. The storage capacitor 30 is charged via an external supply potential applied across terminals 11 and 12. The capacitor charging circuit (33, 34) provides a potential which is applied to a reset $\overline{R}$ terminal of the timer 40 to hold the timer inactive as long as the external supply is connected in the circuit. When the external supply is removed the stored potential on the charged capacitor 30 causes a small reverse current in the charging circuit (20, 34) which produces a potential at the timer reset connection, $\overline{R}$, placing the timer 40 in its operative mode. The timer thereafter produces a control signal, a predetermined time after the external supply is removed, which control signal switches the silicon controlled rectifier (SCR) 36 into conduction and causing the capacitor 30 to be discharged through the load.

The supply potential applied to terminals 11 and 12 may be AC or DC and of either polarity. The diode bridge 10, comprising diodes 13, 14, 15 and 16 is included to insure that the capacitor is charged in the proper polarity for operation of the counter. For example, if a supply potential is connected to the circuit with its negative terminal applied to terminal 11 and its positive terminal to terminal 12, the charging path is from terminal 12, through diode 14, then through the serial connection of capacitor 30, diode 33 and resistor 34. The charging current then courses through diode 16 to terminal 11. Resistor 34 limits the amplitude of the charging current.

A resistor 31 and a zener diode 32, e.g. a 6 volt zener, are serially connected across the capacitor 30. The potential developed across the zener diode 32 is applied to the supply connections Vdd and Vss of the timer 40 to provide energizing potential thereto.

A further potential developed across resistor 34 is applied via resistor 35 to a reset connection $\overline{R}$ of the timer 40. For the timer circuit shown, a low or negative reset potential holds the timer in the reset or initialized state precluding it from producing an output signal on connection 39.

When the capacitor is charging, the potential applied to the reset connection is a forward biased diode potential more negative than the negative supply potential Vss. This insures that the timer is instantaneously reset when supply potential is connected across terminals 11 and 12. As the capacitor becomes fully charged, the reset potential approaches the $V_{SS}$ supply potential. Resistor 35 limits the current available to the reset connection so that excess negative potential cannot damage the reset input circuitry.

Removing the supply potential from terminals 11 and 12 places the timing circuit in the operative mode. The potential stored on the capacitor supplies energizing potential for the timing circuit. In addition, charge from the positive terminal of the capacitor, i.e , 37, is conducted through the resistors 20, 34 and 35 to apply a positive potential to the reset connection enabling the timer to time out a preset timing interval. At the culmination of the timing interval, timer 40 produces an output control signal on connection 39. The control signal fires the SCR 36 completing the circuit including the storage capacitor 30, the load connected across terminals 37 and 38 and the principal conduction path of the SCR 36.

Aborting the operation and energization of the circuit is accomplished in the following manner. The charging potential is reconnected across terminals 11 and 12 (if it has been disconnected). The charging potential is then slowly lowered to zero volts. This permits the storage capacitor to discharge through resistors 20 and 21 while maintaining the reset potential on the timer. Alternatively a resistor may be placed in parallel with the zener diode 32 to provide a serial discharge path with resistor 31. In either case this resistor and resistor 21 are large value resistances so as not to interfere with the normal operation of the circuit, i.e., so that the storage capacitor will not appreciably discharge during the longest timing cycle.

Several aspects of the circuit will be noted at this point. First, if the supply potential applied across terminals 11 and 12 is DC and of known polarity the diode bridge 10 may be eliminated from the circuit. Secondly, the timing circuit can be disabled at any time prior to completion of the timing interval simply by reconnecting the supply potential across terminals 11 and 12. Third, while the switch illustrated in the circuit is an SCR other forms of switching devices may be substituted therefor such as a transistor with its control electrode connected to the timer output connection 39 and its principal conduction path serially connected with the load. Fourth, the storage capacitor may be replaced by a storage battery or another appropriate energy storing element. Finally, the timing circuit 40 may be of a digital counting type, or an RC charge/discharge type so long as it may be accurately programmed and is resettable.

Figure 2:
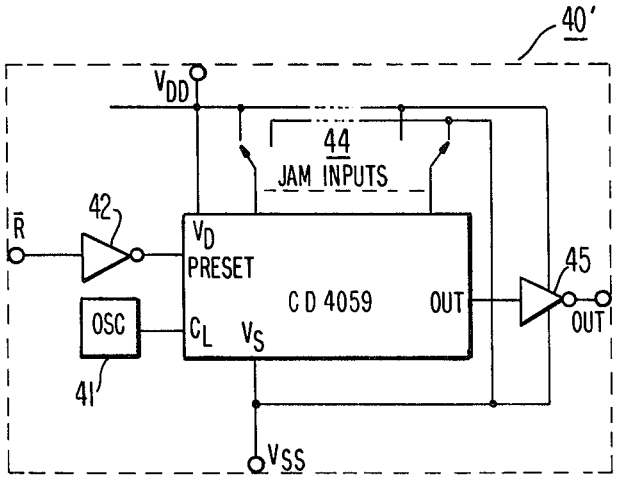
FIG. 2 is a block diagram of the timer incorporated in the FIG. 1 drawing.

FIG. 2 illustrates a digital realization of the timing circuit 40. The digital timing circuit 40' is built around a presettable down counter 43 such as the RCA Corporation CD 4059 COS/MOS Programmable Divide by 'N' counter integrated circuit. This device has a plurality of inputs 44 for programming the necessary number of clock pulses applied to its C1 input to produce a pulse at its OUT connection. Programming is accomplished by connecting respective ones of its input terminals 44 to either positive (Vdd) or negative (Vss) supply potential. Clock pulses are provided by an oscillator 41 and the output of the CD 4059 counter is buffered by an amplifier 45. The counter is preset to count the programmed number by application of a signal to its preset input. The preset signal operates to reset the counter, which signal is provided by inverting (42) the signal applied to the reset connection in the FIG. 1 circuit.

The circuitry of FIG. 2 is conducive to being integrated on a single integrated circuit to realize an economy of parts. It will readily be appreciated that other timing circuits may be designed around other available timing elements such as the RCA Corporation CD 4536 COS/MOS Programmable Timer integrated circuit without straying from the spirit of the invention. Alternatively, dedicated timing circuits may be designed for particular applications.

We claim:

1. A circuit for energizing a load after a predetermined interval comprising:

a timer having a reset terminal and an output terminal for producing a control pulse which is initiated at a predetermined time after removal of a reset signal from the reset terminal;

energy storing means;

switch means having a control terminal connected to the output terminal of said timer, said switch means being serially connected in a closed loop with said load and the energy storing means;

means for applying an external potential to charge the energy storing means;

circuit means for applying a reset potential to said timer reset terminal when said external potential is applied and for applying a non-reset potential derived from said energy storing means in the absence of said external potential; and further circuit means connected across said energy storing means for providing energization supply to said timer.

2. A circuit for energizing a load after a predetermined timing interval comprising:

energy storing means;

switch means having a control terminal, and having a principal conduction path serially connected with said energy storing means;

means for serially connecting a load to be energized with the storing means and said switch means in a closed circuit loop;

a programmable timer having a reset input terminal, and having an terminal connected to the control electrode of said switch means for selectively controlling the conduction of said principal conduction path;

first circuit means connected across said energy storing means for developing supply potentials, said supply potentials being applied to energize the timer;

means for applying a charging potential;

second circuit means serially connected with said means for applying a charging potential and said energy storing means for providing a charging path for said energy storing means, said second circuit means having an intermediate node connected to the reset input terminal of the timer and producing a reset potential thereat when said charging potential is applied; and third circuit means serially connected in a closed loop with said energy storing means and said second circuit means, wherein said third circuit means provides a non-reset potential to the reset input terminal in the absence of said charging potential.

3. The circuit set forth in claim 2, wherein:

said first circuit means comprises the serial connection of a first resistor and a zener diode.

4. The circuit set forth in claim 2 or 3, wherein:

the second circuit means includes the serial connection of a pn junction and a second resistor, said pn junction being connected directly to said energy storage means and poled to conduct charging current thereto, and wherein said intermediate node is at the interconnection of the pn junction and said second resistor.

5. The circuit set forth in claim 2 or 3, wherein the third circuit means includes a further resistor.

6. The circuit set forth in claim 2 or 3, wherein the means for applying a charging potential includes:

first and second supply terminals;

a diode bridge having input terminals connected to said first and second supply terminals and having first and second output terminals serially connected with said energy storing means and said second circuit means, and wherein the potential at the diode bridge output terminals is of singular polarity regardless of the polarity of the potential applied to said first and second supply terminals.

7. The circuit set forth in claims 1, 2 or 3, wherein the switch means comprises a silicon controlled rectifier.

8. The circuit set forth in claims 1 or 2 or 3, wherein:

said timer includes;

an oscillator for generating clock pulses;

a counting circuit responsive to said clock pulses for generating an output signal after the occurrence of a predetermined number of said clock pulses; and means for programming said counting circuit to said predetermined number of clock pulses.

9. The circuit set forth in claims 1 or 2 or 3, wherein the energy storing means is a capacitor.

10. A timing circuit for energizing a load comprising:

an energy storage element;

a resettable timer for generating an output signal at an output terminal thereof, having supply terminals, and a reset terminal, and wherein said supply terminals are connected for receiving supply potential from said storage element;

switch means responsive to said timer output signal and connected in a serial loop with the energy storage element and said load;

means for applying external potential to charge said energy storage element; and means connected to said reset terminal and responsive to said external potential for maintaining the resettable timer reset, and responsive to a potential on said energy storage element for contitioning the timer to an operative mode in the absence of said external potential.

* * * * *

UNITED STATES PATENT AND TRADEMARK OFFICE
CERTIFICATE OF CORRECTION

PATENT NO. : 4,487,125

DATED : Dec. 11, 1984

INVENTOR(S) : Borys Zuk

It is certified that error appears in the above-identified patent and that said Letters Patent is hereby corrected as shown below:

Col. 3, line 68, change "We claim" to - - - What Is Claimed Is - - -.

Col. 4, line 32, after "an" insert - - - output - - -.

Signed and Sealed this

*Thirtieth* Day of *July 1985*

[SEAL]

*Attest:*

DONALD J. QUIGG

*Attesting Officer*

*Acting Commissioner of Patents and Trademarks*